US008571856B2

(12) United States Patent
Kovesi et al.

(10) Patent No.: US 8,571,856 B2
(45) Date of Patent: Oct. 29, 2013

(54) LIMITATION OF DISTORTION INTRODUCED BY A POST-PROCESSING STEP DURING DIGITAL SIGNAL DECODING

(75) Inventors: Balazs Kovesi, Lannion (FR); Stéphane Ragot, Lannion (FR)

(73) Assignee: France Telecom, Paris (FR)

( * ) Notice: Subject to any disclaimer, the term of this patent is extended or adjusted under 35 U.S.C. 154(b) by 602 days.

(21) Appl. No.: 12/667,908

(22) PCT Filed: Jul. 4, 2008

(86) PCT No.: PCT/FR2008/051246

§ 371 (c)(1),
(2), (4) Date: May 14, 2010

(87) PCT Pub. No.: WO2009/010672

PCT Pub. Date: Jan. 22, 2009

(65) Prior Publication Data

US 2010/0241427 A1 Sep. 23, 2010

(30) Foreign Application Priority Data

Jul. 6, 2007 (FR) ..... 07 04901

(51) Int. Cl.
*G10L 21/00* (2013.01)

(52) U.S. Cl.
USPC ..... 704/228; 704/226; 704/230; 704/233

(58) Field of Classification Search
USPC ..... 704/226, 228, 230, 233
See application file for complete search history.

(56) References Cited

U.S. PATENT DOCUMENTS

| | | | | |
|---|---|---|---|---|
| 5,491,514 | A * | 2/1996 | Fukuda et al. | 375/240.1 |
| 6,839,010 | B1 * | 1/2005 | Tsyrganovich | 341/143 |
| 6,915,319 | B1 * | 7/2005 | Sato | 708/313 |
| 6,950,048 | B1 * | 9/2005 | Slavin | 341/131 |
| 7,068,197 | B1 * | 6/2006 | Tsyrganovich | 341/143 |
| 2005/0219095 | A1 * | 10/2005 | Slavin | 341/143 |
| 2006/0119493 | A1 * | 6/2006 | Tal et al. | 341/143 |
| 2006/0217970 | A1 | 9/2006 | Sukkar et al. | |

FOREIGN PATENT DOCUMENTS

WO WO 2005/041170 A1 5/2005

OTHER PUBLICATIONS

Chen et al., "Adaptive Postfiltering for Quality Enhancement of Coded Speech," IEEE Transactions on Speech and Audio Processing, vol. 3(1), pp. 59-71 (Jan. 1995).

(Continued)

*Primary Examiner* — Leonard Saint Cyr
(74) *Attorney, Agent, or Firm* — Drinker Biddle & Reath LLP

(57) ABSTRACT

The invention relates to the processing of a digital signal originating from a decoder and a noise reduction post-processing step, including, in particular, limitation of distortion introduced by the post-processing step in order to deliver a corrected output signal ($S_{OUT}$), assigning said corrected output signal ($S_{OUT}$) with: a current amplitude having an intermediary value between a current amplitude value of the post-processed signal ($S_{POST}$) and a corresponding current amplitude value of the decoded signal ($S'_{MIC}$), or the current amplitude of the post-processed signal ($S_{POST}$), according to the respective values of the current amplitude of the post-processed signal ($S_{POST}$) and by the corresponding current amplitude of the decoded signal ($S'_{MIC}$).

10 Claims, 3 Drawing Sheets

(56) References Cited

OTHER PUBLICATIONS

Yamato et al., "Post-Processing Noise Suppressor with Adaptive Gain-Flooring for Cell-Phone Handsets and IC Recorders," 2007 Digest of Technical Papers, International Conference on Consumer Electronics, Jan. 10, 2007-Jan. 14, 2007, Las Vegas, NV, USA, retrieved from internet website: http://ieeexplore.ieee.org/ie15/4145986/4099325/04146097.pdf?tp=&arnumber=4146097&isnumber=4099325, pp. 1-2 (Jan. 2007).

* cited by examiner

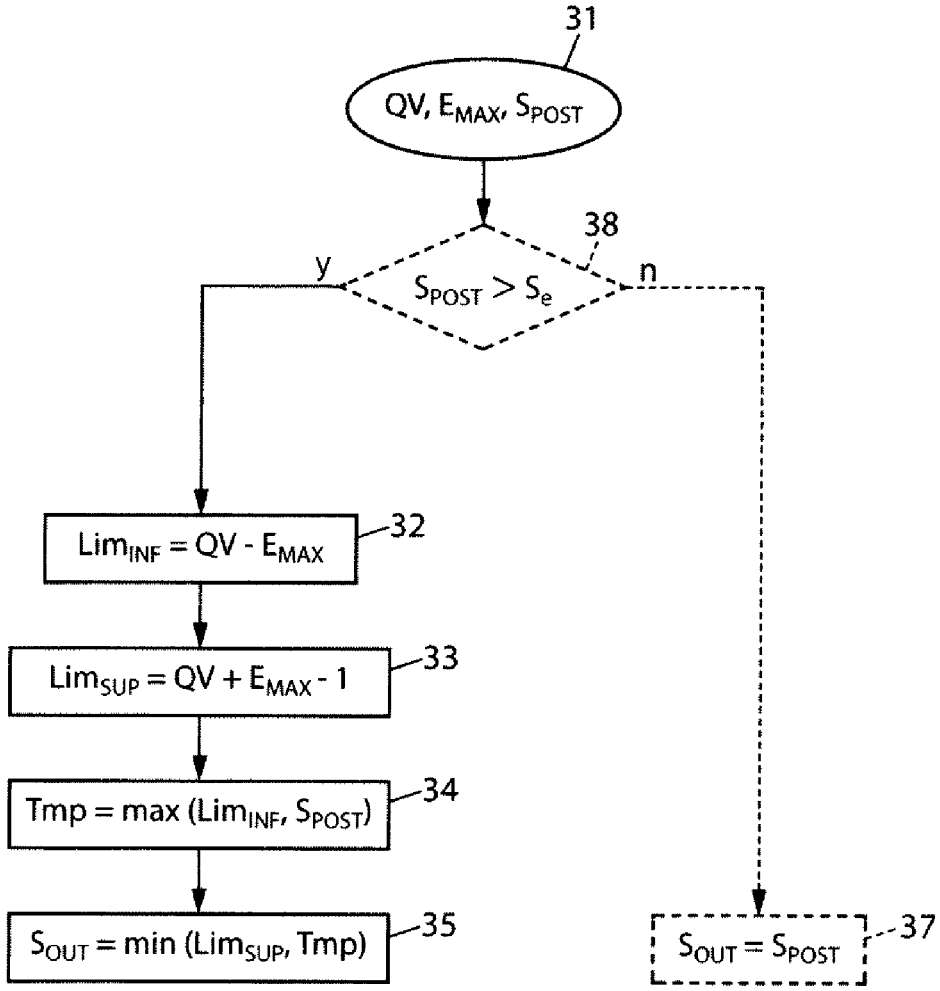
FIG. 3
FIG. 4
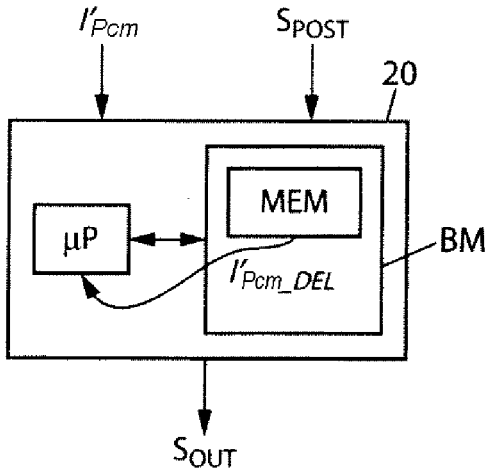

LIMITATION OF DISTORTION INTRODUCED BY A POST-PROCESSING STEP DURING DIGITAL SIGNAL DECODING

CROSS-REFERENCE TO RELATED APPLICATIONS

This application is the U.S. national phase of the International Patent Application No. PCT/FR2008/051246 filed Jul. 4, 2008, which claims the benefit of French Application No. 07 04901 filed Jul. 6, 2007, the entire content of which is incorporated herein by reference.

FIELD OF THE INVENTION

The present invention relates to a signal processing, in particular a processing of digital signals in the field of telecommunications, these signals possibly being for example speech signals, music signals, video signals, or the like.

BACKGROUND OF THE INVENTION

Generally, the bit rate required to pass an audio and/or video signal with sufficient quality is an important parameter in telecommunications. In order to reduce this parameter and thus increase the number of possible communications via one and the same network, audio coders have been developed in particular for compressing the quantity of information required to transmit a signal.

Certain coders make it possible to achieve particularly high information compression factors. Such coders generally use advanced information modeling and quantization techniques. Thus, these coders only transmit models or partial data of the signal.

The decoded signal, although it is not identical to the original signal (since part of the information has not been transmitted on account of the quantization operation), nevertheless remains very close to the original signal (at least from the perception point of view). The difference, in the mathematical sense, between the decoded signal and the original signal is then called "quantization noise".

Signal compression processings are often designed so as to minimize quantization noise and, in particular, to render this quantization noise as inaudible as possible when the processing of an audio signal is involved. Thus, techniques exist which take into account the psycho-acoustic characteristics of hearing, with the aim of "masking" this noise. However, to obtain the lowest possible bit rates, the quantization noise may sometimes be difficult (or indeed impossible) to mask totally, thereby, in certain circumstances, degrading the intelligibility and/or the quality of the signal.

In order to reduce this quantization noise and hence improve quality, two families of techniques can be used on decoding.

It is possible, firstly, to use an adaptive post-filter, of the type described in the article by Chen and Gersho:

"*Adaptive post filtering for quality enhancement of coded speech*", IEEE Transactions on Speech and Audio Processing, Vol. 3, No. 1, Jan. 1995, pages 59-71, and employed in particular in the speech decoders of CELP ("Code Excited Linear Prediction") type.

This involves performing a filtering which improves subjective quality by attenuating the signal in the zones where the quantization noise is most audible (in particular between the formants and the harmonics of fundamental period or "pitch"). Current adaptive post-filters afford good results for speech signals, but less good results for other types of signals (music signals, for example).

Another processing family is aimed at the conventional noise reduction processings which distinguish the useful signal from spurious noise and which can be applied as post-processing to reduce the quantization noise after decoding. This type of processing makes it possible at the origin to reduce the noise related to the signal capture environment and it is often used for speech signals. However, it is impossible to make the processing transparent in relation to the noise related to the sound pick-up environment, thereby posing a problem for music signal coding, in particular. Thus, in coding/decoding, one might want to transmit the "atmospheric" noise and it is then desirable for the noise reduction not to apply to this type of "atmospheric" noise but solely to the quantization noise, in particular in the context of post-processing on decoding aimed at reducing quantization noise.

Nevertheless, these various types of quantization noise reduction methods deform the signal to a greater or lesser extent. For example, the use of a post-filter (denoising) which would be too aggressive for the speech signal would make it possible to completely eliminate the quantization noise but the voice sound obtained would seem less natural and/or muffled. Optimization of these various types of methods is therefore difficult and it is appropriate systematically to find a compromise between:

- the effectiveness of suppression of the quantization noise, and
- the conservation of the properties of the initial signal, in particular in terms of natural or unnatural aspect.

SUMMARY OF THE INVENTION

The present invention aims to improve the situation.

To this end it proposes a method for processing a digital signal, arising from a decoder and from a noise reduction post-processing. The method within the meaning of the invention proposes a limitation of a distortion introduced by the post-processing so as to deliver a corrected output signal, by assigning the corrected output signal:

- a current amplitude having an intermediate value between a current amplitude value of the post-processed signal and a corresponding current amplitude value of the decoded signal,
- or the current amplitude of the post-processed signal, according to the values taken respectively by the current amplitude of the post-processed signal and by the corresponding current amplitude of the decoded signal.

Advantageously, a delay line is provided so as to ensure a temporal correspondence between the current amplitude of the post-processed signal and the corresponding current amplitude of the decoded signal.

In a particular embodiment, the method comprises the steps:

- definition of an interval of permitted amplitudes, the interval comprising a lower bound and an upper bound which are dependent on a current amplitude value of the decoded (but not post-processed) signal, and
- for a corresponding current amplitude of the post-processed signal, assignment of a current amplitude value to the output signal, equal to the value of:
  - the lower bound if the current amplitude of the post-processed signal is below the value of the lower bound,
  - the upper bound if the current amplitude of the post-processed signal is above the value of the upper bound, the current amplitude of the post-processed signal if the value of the current amplitude of the post-processed signal is included in said interval.

Thus, the present invention proposes that the decoded signal not be deviated from, beyond a certain tolerance, during the post-processing of the decoded signal.

It is then possible, in one embodiment, to assign a span of amplitude values to each possible amplitude value of the decoded signal so as to define this tolerance quantitatively, in such a way that the aforesaid lower and upper bounds are chosen so that the difference between the upper bound and the lower bound is equal to this span of values.

This embodiment can advantageously be implemented in the case where the signal received has been coded by a scalar quantization coding, the decoder delivering quantized amplitude values which vary from one to another in a discrete manner, the successive deviations between the quantized values defining successive quantization stepsizes. Thus:

the upper bound can be given by the addition of substantially half the quantization stepsize to the quantized value assigned to the current amplitude of the decoded signal, and the lower bound can be given by the subtraction of substantially half the quantization stepsize from the quantized value assigned to the current amplitude of the decoded signal.

An exemplary scalar quantization coding is so-called "pulse code modulation" coding, delivering a coded index. In this case, it is possible to determine respective current values of the lower and upper bounds simply on the basis of the current coded index, received at the decoder. Moreover, provision may be made for a correspondence table giving, for a current index received, a corresponding quantized value and a half of a corresponding quantization stepsize, on the basis of which can then be are determined the respective current values of the lower and upper bounds.

BRIEF DESCRIPTION OF THE DRAWINGS

Other characteristics and advantages of the invention will be apparent on examining the description detailed hereinbelow and the appended drawings in which:

FIG. 4 illustrates very schematically the hardware structure of a module for limiting distortion within the meaning of the invention.

DETAILED DESCRIPTION

Figure 1:
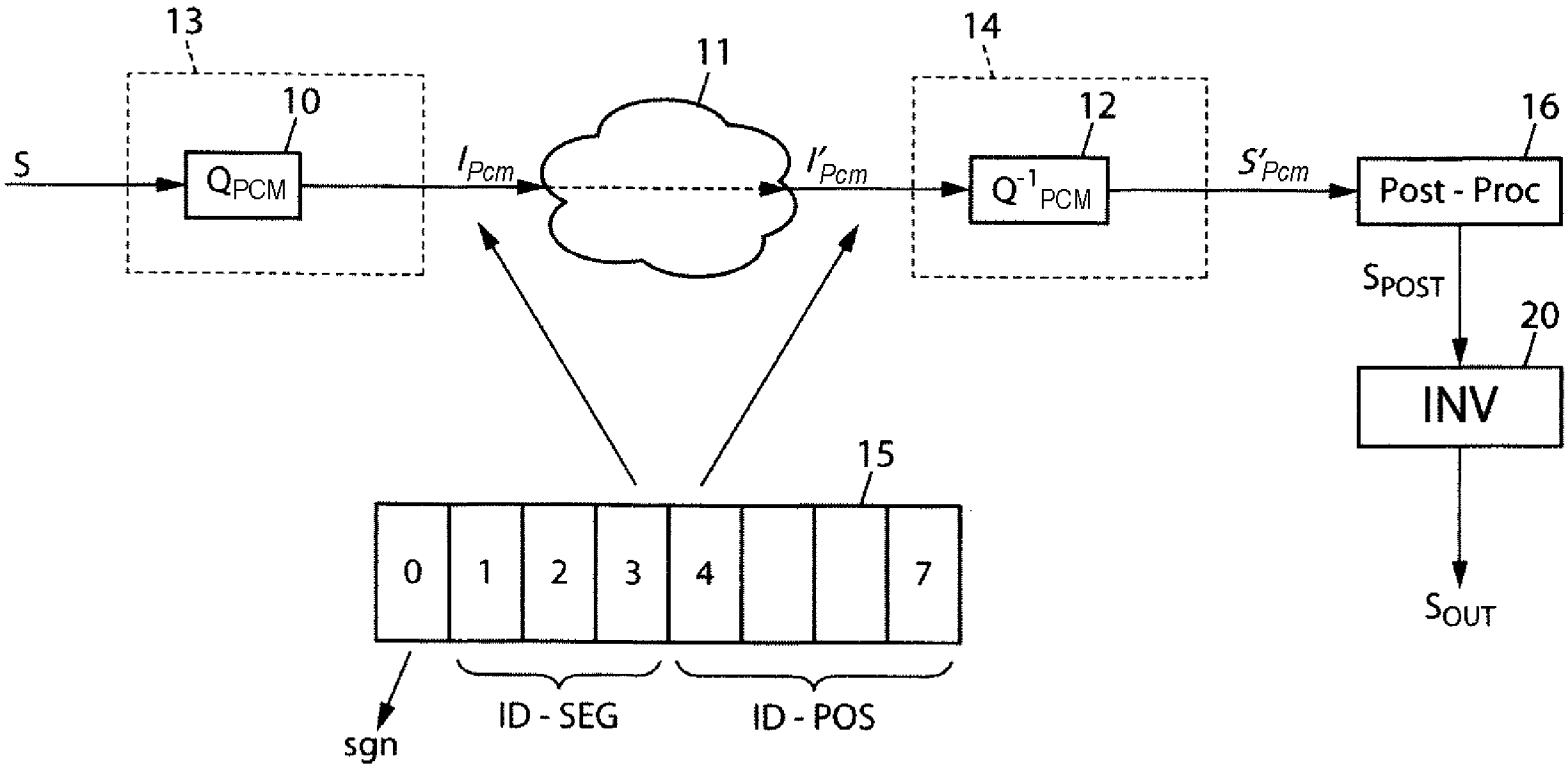
FIG. 1 illustrates very schematically the general structure of a scalar quantization codec, whose decoder is followed by a post-processing and by a module, within the meaning of the invention, for limiting distortion introduced by the post-processing, FIG. 2 schematically illustrates the structure of the module for limiting distortion of FIG. 1 and its interaction with the post-processing module, FIG. 3 schematically illustrates steps for limiting distortion within the meaning of the invention.

The present invention advantageously intervenes in the context of a coding/decoding of the scalar quantization type. For example, in the case of PCM ("Pulse Code Modulation") type coding, each input sample is individually coded, without prediction. The principle of such a codec is recalled with reference to FIG. 1.

This type of coding, within the meaning of the ITU-T G.711 standard, carries out a compression of the signals sampled at 8 kHz, typically defined in a minimum band of frequencies from 300 to 3400 Hz, by a logarithmic curve which makes it possible to obtain a nearly constant signal-to-noise ratio for a wide dynamic range of signals.

More precisely, the quantization stepsize is approximately proportional to the amplitude of the signals. The initial signal S is firstly coded (module 10) in a coder 13 and the resulting sequence of indices $I_{PCM}$ is represented on 8 bits per sample (see the reference 15 of FIG. 1), this therefore corresponding to 256 quantization levels ($2^8$=256). In the switched telephone network 11, these 8 bits are transmitted at a frequency of 8 kHz to give a bit rate of 8×8=64 kbits/s. At the decoder 14, on receipt of the signal $I'_{Pcm}$ delivered by the network 11, the finally decoded signal $S'_{Pcm}$ is obtained at the output of the inverse quantizer 12. In practice, if the inverse quantization is overseen by a table, it simply consists in pointing an index in a table comprising 256 quantized values listed in chart 1 hereinbelow. This chart 1 is established for the ITU-T G.711 standard such as it is implemented in Europe (so-called "A-law" practice).

For example, an original sample of the signal S to be coded has an amplitude equal to −75. Consequently, this amplitude lies in the interval [−80, −65] of row 123 (or "level" 123) of the chart. The coding of this information consists in delivering a coded final index, referenced $I'_{Pcm}$ in FIG. 1 and in chart 1, which is equal to 0x51. On decoding, the inverse quantization operation therefore consists in recovering the index $I'_{Pcm}$=0x51 and in matching it with a quantized value QV, such that QV=−72. Consequently, the decoding assigns this value −72 to the amplitude of the corresponding sample of the decoded signal $S'_{Pcm}$. It will be noted that this same value QV=−72 would be assigned to all the samples to be decoded whose initial amplitude had a value in the interval [−80, −65], i.e. in all 16 possible values in the interval, this corresponding to the quantization stepsize here of 16. On the other hand, it will be noted that the same value QV=32256 would be assigned to all the samples whose initial amplitude was in the interval [31744, 32767], i.e. in all 1024 possible values, this corresponding to a quantization stepsize of 1024.

CHART 1

| Level | Lower threshold | Upper threshold | $I'_{Pcm}$ | Quantized value (QV) |
|---|---|---|---|---|
| 0 | −32768 | −31745 | 0x2a | −32256 |
| 1 | −31744 | −30721 | 0x2b | −31232 |
| ... | ... | ... | ... | ... |
| 122 | −96 | −81 | 0x50 | −88 |
| 123 | −80 | −65 | 0x51 | −72 |
| 124 | −64 | −49 | 0x56 | −56 |
| 125 | −48 | −33 | 0x57 | −40 |
| 126 | −32 | −17 | 0x54 | −24 |
| 127 | −16 | −1 | 0x55 | −8 |
| 128 | 0 | 15 | 0xd5 | 8 |
| 129 | 16 | 31 | 0xd4 | 24 |
| 130 | 32 | 47 | 0xd7 | 40 |
| 131 | 48 | 63 | 0xd6 | 56 |
| 132 | 64 | 79 | 0xd1 | 72 |
| 133 | 80 | 95 | 0xd0 | 88 |
| ... | ... | ... | ... | ... |
| 254 | 30720 | 31743 | 0xab | 31232 |
| 255 | 31744 | 32767 | 0xaa | 32256 |

To facilitate its implementation, the PCM compression is carried out by a segment-based linear amplitude compression. In the ITU-T G.711 standard, the bits characterizing 256 quantized values are thus distributed in the following manner:

1 sign bit (0 for a negative value; and 1 otherwise), bearing the reference sgn in FIG. 1, 3 bits to indicate a segment identifier from 0 to 7 (charts 2 and 3), bearing the reference ID-SEG in FIG. 1, and 4 bits to specify the location of a level on a current segment, bearing the reference ID-POS in FIG. 1.

In the G.711 standard according to the A-law in particular, the quantization stepsize is multiplied by two (16, 32, 64, . . . ) on passing from one segment to the next, doing so from the second segment onward. This coding law therefore makes it possible to have a quantization precision of 12 bits (with a quantization stepsize of 16) on the first two segments of indices 0 and 1 (chart 2). Then, the precision decreases by 1 bit at each incrementation of the segment index (the quantization stepsize being multiplied by two at each incrementation), as shown by chart 2 hereinbelow.

CHART 2

| ID-SEG | Lower threshold | Upper threshold | Quantization stepsize | Position of highest-order bit | $E_{MAX}$ |
|---|---|---|---|---|---|
| 0 | 0 | 255 | 16 | <8 | 8 |
| 1 | 256 | 511 | 16 | 8 | 8 |
| 2 | 512 | 1023 | 32 | 9 | 16 |
| 3 | 1024 | 2047 | 64 | 10 | 32 |
| 4 | 2048 | 4095 | 128 | 11 | 64 |
| 5 | 4096 | 8191 | 256 | 12 | 128 |
| 6 | 8192 | 16383 | 512 | 13 | 256 |
| 7 | 16384 | 32767 | 1024 | 14 | 512 |

Chart 2 is interpreted as follows. By way of example, if the amplitude of an original sample equals −30000:

the index of the associated segment "7" is coded on 3 bits, the sign "−" is coded on 1 bit (set to 0), and the 4 remaining bits (13, 12, 11 and 10) define the amplitude level in the segment of index 7.

Likewise, if the amplitude of an original sample equals +4000:

the index of the associated segment "4" is coded on 3 bits, the sign "+" is coded on 1 bit (set to 1), and the 4 remaining bits (3, 2, 1 and 0) define the amplitude level in the segment of index 4.

Chart 3 hereinbelow is the equivalent of chart 2, but for the G.711 standard such as it is practiced in particular in the United States of America or in Japan (termed the "μ-law"), with in particular the quantization stepsizes and the maximum possible deviations $E_{MAX}$ between the quantized value QV and the real value of the amplitude of the original sample.

CHART 3

| ID-SEG | Lower threshold | Upper threshold | Quantization stepsize | $E_{MAX}$ |
|---|---|---|---|---|
| 0 | 0 | 123 | 8 | 4 |
| 1 | 124 | 379 | 16 | 8 |
| 2 | 380 | 891 | 32 | 16 |
| 3 | 892 | 1915 | 64 | 32 |
| 4 | 1916 | 3963 | 128 | 64 |
| 5 | 3964 | 8059 | 256 | 128 |
| 6 | 8060 | 16251 | 512 | 256 |
| 7 | 16252 | 32635 | 1024 | 512 |

Returning to row 123 of chart 1, all the 16 values of the interval [−80, −65] are represented by the code word of 0x51 which, once decoded, gives the quantized value −72. However, it should be noted that conversely, by obtaining a decoded value −72, it is certain that the original value which has been coded was in the interval [−80, −65]. It is therefore known that the maximum amplitude of the coding error for this sample is $E_{MAX}$=8, this corresponding to half the quantization stepsize.

In what follows, it will be supposed that the final index $I'_{Pcm}$ received at the decoder makes it possible to determine, on the one hand, the quantized value QV and, on the other hand, the segment index ID-SEG on the basis of which the quantization stepsize can be deduced and, from this, the maximum amplitude of the coding error $E_{MAX}$. It will also be noted that the index of the segment ID-SIG can be found also as a function of the position of the highest-order bit of the amplitude of the signal in the case of a G.711 coding according to the A-law (chart 2). As a general rule, it will also be supposed that a specific feature of PCM coding is that the original sample and the decoded sample always have their amplitude in one and the same quantization interval:

for the original sample, at any position in the interval, and for the decoded sample, systematically in the middle of the interval.

Again with reference to FIG. 1, the decoded signal $S'_{Pcm}$ thereafter undergoes a post-processing filtering 16 (for example a denoising or the application of a perceptual post-filter). The resulting signal $S_{POST}$ is then processed by a module 20 within the meaning of the invention.

Indeed, as indicated previously, the post-processing 16 (even if it is in general of linear phase type so as to preserve the waveform) may be too aggressive and impair in particular the natural aspect of a speech signal. At the decoder, information about the original signal is nevertheless available and can be utilized, within the meaning of the present invention, to limit the deviation between the decoded and post-filtered signal $S_{POST}$, on the one hand, and the original signal S, on the other hand. Thus the module 20 (FIG. 1) makes it possible, within the meaning of the invention, to limit the distortion engendered by the post-processing implemented on decoding.

A possible exemplary embodiment, described in detail further on, is to require that the distortion introduced by the post-processing 16 with respect to the decoded signal $S'_{Pcm}$ cannot be greater than the maximum amplitude of the coding error $E_{MAX}$. This therefore ensures that the post-filtered signal remains in the same quantization interval as the original signal. The overall distortion due to the coding/decoding processing and post-processing is limited, and in particular very close to the maximum distortion of the coding $E_{MAX}$. This measure also ensures that the energy distribution between successive samples and the overall waveform are well preserved.

Figure 2:
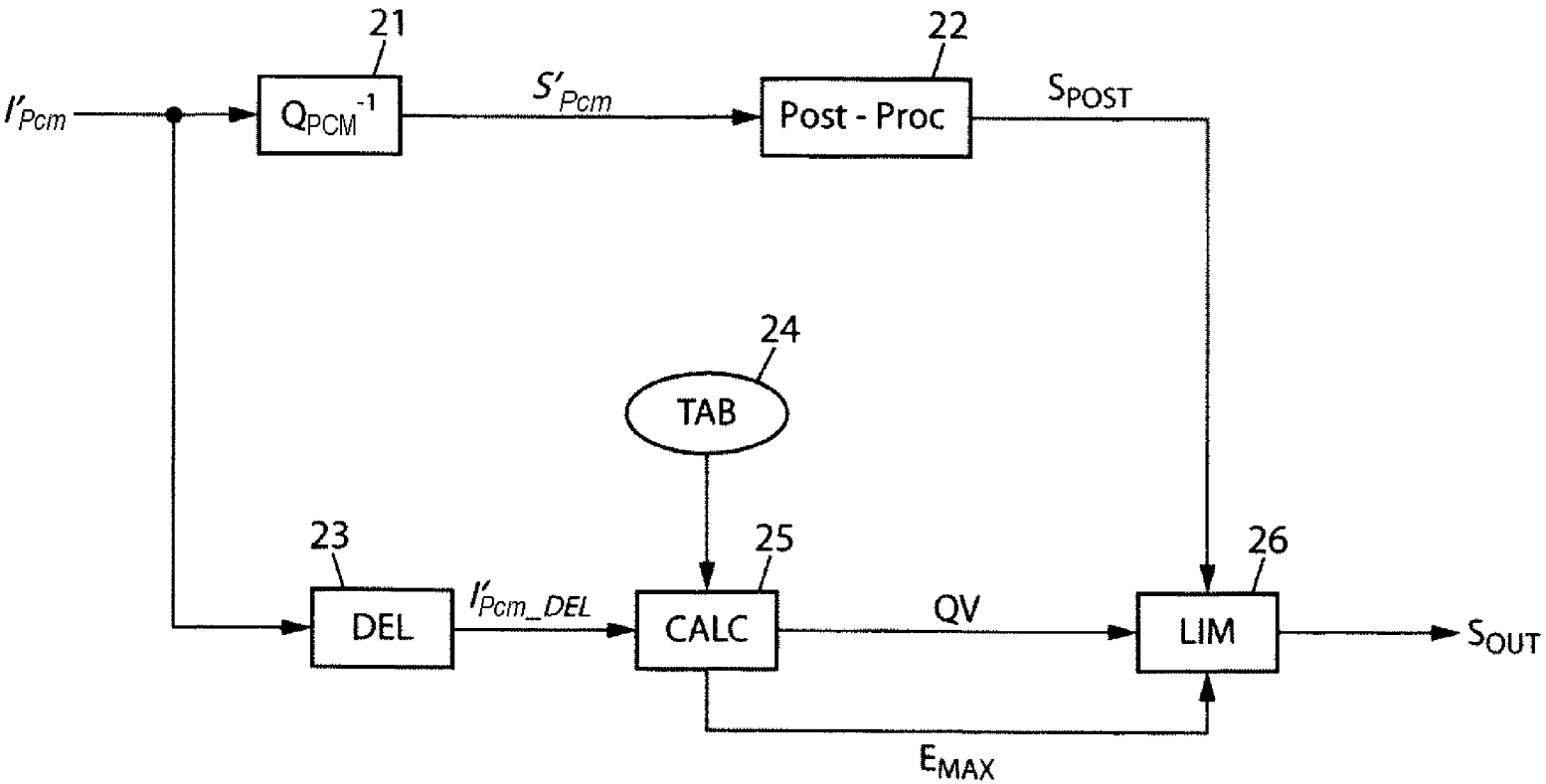

An exemplary implementation of the invention is illustrated in FIG. 2. On receipt of a coded final index $I'_{Pcm}$, the module 21 calculates the decoded sample $S'_{Pcm}$ by inverse quantization of the index $I'_{Pcm}$ received. The module 22 performs the above-mentioned post-processing. It will also be supposed that this operation introduces, in general, a delay. In parallel, provision is made for a processing within the meaning of the invention which advantageously begins with a delay line (module 23) to which the index received $I'_{Pcm}$ is also applied. In particular, the delay is adjusted so that the delayed index $I'_{Pcm_DEL}$ is aligned over time with the current sample delivered by the output $S_{POST}$ of the post-processing 22.

An exemplary embodiment of the delay line 23 can be the following. Assuming that the post-processing 22 introduces a delay of 16 samples, the module 23 then comprises, in an advantageous manner, a memory MEM of 16 samples, with shift register. For example, the index 0 of this memory corresponds to the oldest sample, whereas the index 15 corresponds to the last sample stored. Thus, when a new index arrives at the input of the module 23, the following operations are carried out:

the output of the module 23 containing the oldest stored sample is now such that: $I'_{Pcm_DEL}$=MEM(0), a memory shift is applied: MEM(i)=MEM(i+1), for i=0, . . . 14, the newly arrived sample is stored: MEM(15)=$I'_{Pcm}$.

On the basis of the delayed index $I'_{Pcm_DEL}$, the module 25 determines the corresponding quantized value QV and the corresponding maximum coding error $E_{MAX}$, for example on the basis of a table 24 which can comprise data of chart 1 above. The data of chart 1 have been retraced in chart 4 hereinbelow, and this data can be used for the determination of the parameters QV and $E_{MAX}$, effected by the module 25.

CHART 4

| Index received $I'_{Pcm}$ | Quantized value QV | Maximum error $E_{MAX}$ |
|---|---|---|
| 0x2a | −32256 | 512 |
| 0x2b | −31232 | 512 |
| . . . | . . . | . . . |
| 0x50 | −88 | 8 |
| 0x51 | −72 | 8 |
| 0x56 | −56 | 8 |
| 0x57 | −40 | 8 |
| 0x54 | −24 | 8 |
| 0x55 | −8 | 8 |
| 0xd5 | 8 | 8 |
| 0xd4 | 24 | 8 |
| 0xd7 | 40 | 8 |
| 0xd6 | 56 | 8 |
| 0xd1 | 72 | 8 |
| 0xd0 | 88 | 8 |
| . . . | . . . | . . . |
| 0xab | 31232 | 512 |
| 0xaa | 32256 | 512 |

Here, the information given by chart 4 evolves as a function of the quantized value QV to show that this chart 4 is derived from chart 1 given above. However, in practice and as explained further on, it is preferable to use a table 24 which, as input, catalogs the received and delayed indices $I'_{Pcm_DEL}$ and, as output, gives the corresponding parameters QV and $E_{MAX}$. Chart 5 hereinbelow contains the same data as chart 4, but it is arranged according to the index values $I'_{Pcm_DEL}$.

Thus, chart 5 presents the respective parameters QV and $E_{MAX}$ as a function of a given index $I'_{Pcm_DEL}$ and can therefore constitute, for the G.711 A-law standard, the content of table 24 of FIG. 2.

CHART 5

| Index received and delayed $I'_{Pcm}$_DEL | Quantized value QV | Maximum error $E_{MAX}$ |
|---|---|---|
| 0x00 | −5504 | 128 |
| 0x01 | −5248 | 128 |
| . . . | . . . | . . . |
| 0x7a | −1008 | 16 |
| 0x7b | −976 | 16 |
| 0x7c | −816 | 16 |
| 0x7d | −784 | 16 |
| 0x7e | −880 | 16 |
| 0x7f | −848 | 16 |
| 0x80 | 5504 | 128 |
| 0x81 | 5248 | 128 |
| 0x82 | 6016 | 128 |
| 0x83 | 5760 | 128 |
| 0x84 | 4480 | 128 |
| 0x85 | 4224 | 128 |
| . . . | . . . | . . . |

CHART 5-continued

| Index received and delayed $I'_{Pcm}$_DEL | Quantized value QV | Maximum error $E_{MAX}$ |
|---|---|---|
| 0xfe | 880 | 16 |
| 0xff | 848 | 16 |

Of course, it would be possible, as a variant, to present the decoded signal $S'_{Pcm}$ (before post-processing) to the input of the delay line 23 and, on the basis of the quantized value QV assigned to each sample, deduce therefrom the corresponding parameter $E_{MAX}$. A table 24 laid out according to chart 4 given above would then be used.

However, this embodiment is less advantageous in particular in the coding according to the μ-law, for which the equivalent of chart 1, given for the A-law, is given hereinbelow in chart 6.

It will indeed be noted in chart 6 that one and the same quantized value QV=0 is assigned for different received indices: $I'_{Pcm}$=0x7f and $I'_{Pcm}$=0xff. Thus, in the case of a coding according to the μ-law, when the module 25 operates on the basis of the index received (and not on the basis of the quantized value), the bounds of the intervals in which the amplitude of an original sample could have lain can be more finely determined.

CHART 6

| Level | Lower threshold | Upper threshold | Final index $I'_{Pcm}$ | Quantized value QV |
|---|---|---|---|---|
| 0 | −32768 | −31613 | 0x00 | −32124 |
| 1 | −31612 | −30589 | 0x01 | −31100 |
| . . . | . . . | . . . | . . . | . . . |
| 122 | −44 | −37 | 0X7a | −40 |
| 123 | −36 | −29 | 0x7b | −32 |
| 124 | −28 | −21 | 0x7c | −24 |
| 125 | −20 | −13 | 0x7d | −16 |
| 126 | −12 | −5 | 0X7e | −8 |
| 127 | −4 | −1 | 0x7f | 0 |
| 128 | 0 | 3 | 0xff | 0 |
| 129 | 4 | 11 | 0xfe | 8 |
| 130 | 12 | 19 | 0xfd | 16 |
| 131 | 20 | 27 | 0xfc | 24 |
| 132 | 28 | 35 | 0xfb | 32 |
| 133 | 36 | 43 | 0xfa | 40 |
| . . . | . . . | . . . | . . . | . . . |
| 254 | 30588 | 31611 | 0x81 | 31100 |
| 255 | 31612 | 32767 | 0x80 | 32124 |

The data that a table 24 can comprise in a processing of the type represented in FIG. 2, has thus been represented in chart 7 hereinbelow, in a context of coding according to the μ-law.

CHART 7

| Index received and delayed $I'_{Pcm}$_DEL | Quantized value QV | Maximum error $E_{MAX}$ |
|---|---|---|
| 0x00 | −32124 | 512 |
| 0x01 | −31100 | 512 |
| . . . | . . . | . . . |
| 0x7a | −40 | 4 |
| 0x7b | −32 | 4 |
| 0x7c | −24 | 4 |
| 0x7d | −16 | 4 |
| 0x7e | −8 | 4 |
| 0x7f | 0 | 2 |
| 0x80 | 32124 | 512 |
| 0x81 | 31100 | 512 |

CHART 7-continued

| Index received and delayed $I'_{Pcm}$_DEL | Quantized value QV | Maximum error $E_{MAX}$ |
|---|---|---|
| 0x82 | 30076 | 512 |
| 0x83 | 29052 | 512 |
| 0x84 | 28028 | 512 |
| 0x85 | 27004 | 512 |
| ... | ... | ... |
| 0xfe | 8 | 4 |
| 0xff | 0 | 2 |

The table 24 (which can therefore include the data of charts 5 or 7) can be hard-stored in a memory of a module 20 (FIG. 1) within the meaning of the invention. However, in a less memory-expensive variant embodiment, the parameters $E_{MAX}$ and QV are calculated directly on the basis of the index received, without resorting to a table 24, as follows.

Actually, the identifier of the segment ID-SEG is coded on three bits in the index received and delayed $I'_{Pcm_DEL}$ (bits 1, 2, 3 of FIG. 1). Thus, the module 25 can calculate the maximum coding error $E_{MAX}$ related to this segment of identifier ID-SEG, on the basis of a function of simple correspondence between the identifier ID-SEG and the parameter $E_{MAX}$, this function possibly being constructed on the basis:

- of the existing function relating the identifier ID-SEG to the quantization stepsize
- and of the existing function relating the quantization stepsize to the maximum coding error $E_{MAX}$,
- in accordance with charts 2 and 3 given previously.

Thereafter, the module 26 verifies whether the deviation between the post-processed sample $S_{POST}$ and the sample just decoded without post-processing $S'_{Pcm}$ does not exceed the value found of the parameter $E_{MAX}$, in which case the post-processing has induced distortions that it is appropriate to limit. In an exemplary embodiment, the value of the sample $S_{POST}$ is thus reduced to a value closer to the quantized value QV, so that the deviation between the values $S_{POST}$ and QV remains below an authorized threshold.

Accordingly, the module 26 operates, as follows, on the basis:

- of a post-processed current sample $S_{POST}$,
- of the quantized value QV of the corresponding sample just decoded without post-processing, and
- of the maximum coding error $E_{MAX}$ found with this quantized value QV.

FIG. 3 details the operations of the module 26 of FIG. 2 in the form of a flowchart. The inputs of this module are therefore the post-processed samples $S_{POST}$, the corresponding quantized values QV and the corresponding maximum coding errors $E_{MAX}$ (step 31). In steps 32 and 33, the limits, respectively lower $Lim_{INF}$ and upper $Lim_{SUP}$, of the quantization interval around the current quantized value QV are determined. In step 34, a check is carried out to verify whether the post-processed sample $S_{POST}$ has an amplitude below the lower limit $Lim_{INF}$. Thus, the temporary variable Tmp is fixed:

- either at the amplitude value of the sample $S_{POST}$,
- or at that of the authorized lower limit $Lim_{INF}$ (if the amplitude $S_{POST}$ is below the limit $Lim_{INF}$).

The same check is performed in step 35, but for the upper limit $Lim_{SUP}$. Finally the output $S_{OUT}$ gives:

- either the unchanged value of the amplitude of the sample $S_{POST}$ (if it was already in the interval delimited by the limits $Lim_{INF}$ and $Lim_{SUP}$),
- or the lower limit $Lim_{INF}$ (if the amplitude of the sample $S_{POST}$ was below this limit $Lim_{INF}$),
- or else the upper limit $Lim_{SUP}$ (if the amplitude of the sample $S_{POST}$ was above this limit $Lim_{SUP}$).

Thus the output signal $S_{OUT}$ always remains in the same quantization interval as the original signal S.

In this exemplary embodiment, the output signal is strictly reduced to the quantization interval of the original signal, delimited by:

$$[S'_{Pcm}-E_{MAX}, S'_{Pcm}+E_{MAX}-1].$$

Of course, the interval in which it is desired to preserve the amplitude of the output signal with respect to the quantized value found could be defined otherwise. For example provision may be made for:

- an interval of the type $[S'_{Pcm}-E_{MAX}, S'_{Pcm}+E_{MAX}]$, slightly magnified so as to render it symmetric, or else
- an interval of the type $[S'_{Pcm}-\alpha E_{MAX}, S'_{Pcm}+\alpha E_{MAX}]$, where the value of the term $\alpha$ can be greater than 1 so as to further magnify the interval and tolerate more deviation with respect to the quantized value QV, or else
- an interval of the type $[S'_{Pcm}-f_1, S'_{Pcm}+f_2]$ determined by functions $f_1$ and $f_2$ for example of the parameter $E_{MAX}$ and/or of the parameter QV, or other, or else
- an interval of the type $[S'-E_{MAX}, S'+E_{MAX}]$, where S' can be the output of any decoder, so that the distortion of the post-processing would be limited as if dealing with a signal decoded by a PCM decoder (the segment identifier would in this case be determined, in the absence of the index received $I'_{Pcm}$ as in the PCM coding of the G.711 standard, simply on the basis of the position of the highest-order bit of the amplitude of the signal (chart 2)), or else
- an interval of the type $[S'-\beta.|S'|, S'+\beta.|S'|]$, where S' is the output of any decoder and the bounds of the interval are proportional to the amplitude of the signal (for example with $\beta$ less than 1).

In the last two examples, the distortion of the post-processing is limited with respect to the decoded signal, and not necessarily with respect to the original signal, according to the type of coding/decoding employed.

In the exemplary embodiment illustrated in FIG. 3, there may be provision for an optional (illustrated dotted for this reason) prior step 38, to prevent the limitation of distortion due to the post-processing from being applied in a systematic manner. In certain cases, it is indeed advantageous to disable the processing of FIG. 2.

The signal-to-noise ratio (denoted SNR hereinbelow), obtained by the PCM coding/decoding, is substantially constant (of a level of about 38 dB) for a wide dynamic range of signals. On the other hand, for the low signal levels (in the first identifier segment 0 typically) the SNR ratio is low and may even be negative at the start of the segment of the amplitude compression law. The output of the PCM decoder is then very "noisy" for the signals of low amplitude (for example in the cases of silence between two sentences of a speech signal). Moreover, it is difficult to suppress the PCM coding/decoding noise simply with a post-filter, having regard to the very low SNR ratio. A solution often consists in modifying the post-processing of signals of very low amplitude by greatly decreasing the amplitude of the decoded signal. The amplitude of the signal resulting from this type of post-processing is absolutely not faithful, therefore, to the amplitude of the original signal. Under these conditions, it is preferable to disable the limitation of distortion due to the post-processing and steps 32 to 35 of the processing within the meaning of the invention (FIG. 3) are then avoided.

Thus, with reference to FIG. 3, for post-filtered samples $S_{POST}$ whose amplitude is below or equal to a given threshold (output n of the test 38 of comparison with the threshold $S_e$), steps 32 to 35 are not implemented and the amplitude of the output samples $S_{OUT}$ takes directly the value of the amplitude of the post-filtered samples $S_{POST}$ (step 37). In an exemplary implementation of this embodiment, the value of the threshold $S_e$ is equal to 24 (in the scale, of course, of the charts given hereinabove). On the other hand, if the amplitude of the post-filtered samples remains above the threshold $S_e$ (output y of the test 38), the processing aimed at limiting the distortion is applied (steps 32 to 35 described previously). Thus, the method within the meaning of the invention is finally implemented only for decoded and post-processed signals $S_{POST}$ whose amplitude is above the predetermined threshold value $S_e$.

Of course, the present invention is not limited to the form of embodiment described above by way of example; it extends to other variants.

For example, the distortion limitation module 20 is represented in FIG. 1 downstream of the post-processing module 16. As a variant, it can be integrated directly into the post-processing module 16. Moreover, this variant can be advantageous in particular within the framework of the use of recursive infinite impulse response (IIR) filters. Indeed, in the case of the use of an IIR filter, the output sample from the filter depends on the previous outputs from this filter. Thus, by integrating a module within the meaning of the invention into a post-processing using a filtering of IIR type, the output of the IIR filtering can take account directly of the values which have immediately been modified by the module within the meaning of the invention.

Moreover, an exemplary embodiment has been described above in which intervals were defined around the decoded value S' (which can be the quantized value QV in the case of a scalar quantization coding/decoding of the type described above). However, this embodiment was described by way of nonlimiting example. Provision may be made, as a variant, to assign to the amplitude of the output signal $S_{OUT}$ the mean (or more generally a weighted mean) between the decoded value S' and the post-processed amplitude value $S_{POST}$, while authorizing the direct assignment of the post-processed amplitude value $S_{POST}$ if, for example, this latter $S_{POST}$ is still in a chosen interval. Thus, by defining lower $Lim_{INF}$ and upper $Lim_{SUP}$ limits of intervals, or by defining means (optionally weighted) between the decoded value S' and the post-processed amplitude $S_{POST}$, a possible intermediate value that can be taken by the output signal $S_{OUT}$, corrected within the meaning of the invention, is always defined.

More generally, the present invention applies to any type of coding/decoding, beyond a coding according to the G.711 standard, and for example the embodiment described in detail above can be applied in particular in the case of a scalar quantization coding/decoding with any number of levels, followed, on decoding, by a linear-phase type post-processing.

The present invention is also aimed at a digital signal processing module 20, this signal being decoded by an upstream decoder 14 (FIG. 1) and undergoing a noise reduction post-processing 16. This processing module 20 within the meaning of the invention thus comprises means 23, 24, 25, 26 (FIG. 2) for implementing the method for limiting a distortion introduced by the post-processing. Hardware-wise, this module 20 within the meaning of the invention typically comprises, with reference to FIG. 4, a processor μP cooperating with a memory block BM including a storage and/or work memory, as well as the aforesaid memory MEM in the guise of means for embodying, in an exemplary embodiment, the delay line 23 and providing the delayed index $I'_{Pcm_DEL}$. The memory block BM can furthermore comprise a means for storing (preferably in read-only memory) the correspondence table 24 of FIG. 2, or else a computer program for calculating directly the decoded value and the corresponding interval on the basis of the delayed index $I'_{Pcm_DEL}$, according to the embodiment adopted. As indicated above, the module 20 can be independent or integrated into a noise reduction post-processing module.

A storage memory of such a module 20 can advantageously also comprise a computer program comprising instructions for implementing the method within the meaning of the invention, when these instructions are executed by a processor μP of the module 20. Typically, FIG. 3 can illustrate a flowchart representing the algorithm of such a computer program.

The invention claimed is:

1. A method for processing a digital signal, which has been decoded and to which noise reduction post-processing has been applied, to deliver a corrected output signal with reduced distortion introduced by the post-processing, said method comprising the steps of:

assigning to the digital signal a current amplitude having an intermediate value between a current amplitude value of the post-processed signal and a corresponding current amplitude value of the decoded signal, or the current amplitude value of the post-processed signal, according to the respective values of the current amplitude of the decoded signal and the current amplitude of the post-processed signal, defining an interval of permitted amplitudes, the interval comprising a lower bound and an upper bound which are dependent on a current amplitude value of the decoded signal, and for a corresponding current amplitude of the post-processed signal, assigning a current amplitude value to the output signal, equal to the value of:

the lower bound if the current amplitude of the post-processed signal is below the value of the lower bound, the upper bound if the current amplitude of the post-processed signal is above the value of the upper bound, and the current amplitude of the post-processed signal if the value of the current amplitude of the post-processed signal is included in said interval.

2. The method as claimed in claim 1, wherein a span of amplitude values is assigned to each possible amplitude value of the decoded signal, and the lower and upper bounds are chosen so that the difference between the upper bound and the lower bound is equal to said span of values.

3. The method as claimed in claim 2, wherein the signal received has been coded by a scalar quantization coding, the decoder delivering quantized amplitude values, which vary from one to another in a discrete manner, the successive deviations between the quantized values defining quantization stepsizes, and wherein:

the upper bound is given by the addition of substantially half the quantization stepsize to the quantized value assigned to the current amplitude of the decoded signal, and the lower bound is given by the subtraction of substantially half the quantization stepsize from the quantized value assigned to the current amplitude of the decoded signal.

4. The method as claimed in claim 3, wherein the signal received has been coded by a pulse code modulation coding delivering a coded index and wherein respective current values of the lower and upper bounds are determined based on a current coded index, received at the decoder.

5. The method as claimed in claim 4, wherein a correspondence table is provided to give, for a current index received, a corresponding quantized value and a half of a corresponding quantization stepsize, which are determined based on the respective current values of the lower and upper bounds.

6. The method as claimed in claim 1, wherein a delay line is provided so as to ensure a temporal correspondence between said current amplitude of the post-processed signal and said corresponding current amplitude of the decoded signal.

7. The method as claimed in claim 1, implemented for decoded and post-processed signals whose amplitude is above a predetermined threshold value.

8. A non-transitory computer readable medium comprising a computer program comprising instructions for implementing the method as claimed in claim 1.

9. A digital signal processing module for processing a digital signal, the signal being decoded and undergoing a noise reduction post-processing, said module limiting a distortion introduced by the post-processing and comprising:

a hardware processor that assigns to the digital signal a current amplitude having an intermediate value between a current amplitude value of the post-processed signal and a corresponding current amplitude value of the decoded signal, or the current amplitude value of the post-processed signal, according to the respective values of the current amplitude of the decoded signal and the current amplitude of the post-processed signal, the hardware processor defines an interval of permitted amplitudes, the interval comprising a lower bound and an upper bound which are dependent on a current amplitude value of the decoded signal, and the hardware processor, for a corresponding current amplitude of the post-processed signal, assigns a current amplitude value to the output signal, equal to the value of:

the lower bound if the current amplitude of the post-processed signal is below the value of the lower bound, the upper bound if the current amplitude of the post-processed signal is above the value of the upper bound, and the current amplitude of the post-processed signal if the value of the current amplitude of the post-processed signal is included in said interval.

10. A noise reduction post-processing module comprising the digital signal processing module according to claim 9.

* * * * *